US009058022B2

(12) United States Patent
Tokiwa et al.

(10) Patent No.: US 9,058,022 B2
(45) Date of Patent: Jun. 16, 2015

(54) ELECTRONIC TIMEPIECE AND OPERATION DETECTION METHOD OF ELECTRONIC TIMEPIECE

(71) Applicant: CASIO COMPUTER CO., LTD., Tokyo (JP)

(72) Inventors: Teruhisa Tokiwa, Kunitachi (JP); Mitsuaki Matsuo, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 148 days.

(21) Appl. No.: 13/721,362

(22) Filed: Dec. 20, 2012

(65) Prior Publication Data

US 2013/0163393 A1 Jun. 27, 2013

(30) Foreign Application Priority Data

Dec. 27, 2011 (JP) ..... 2011-285599

(51) Int. Cl.
*G04B 27/02* (2006.01)
*G04C 3/00* (2006.01)
*G04G 5/00* (2013.01)

(52) U.S. Cl.
CPC ..... *G04B 27/02* (2013.01); *G04C 3/004* (2013.01); *G04G 5/00* (2013.01)

(58) Field of Classification Search
CPC . G04C 9/00–9/08; G04C 3/007; G04C 3/004; G04G 21/00; G04G 5/00–5/04; G04B 27/02; G04B 29/00; G04B 43/00; G04B 37/00
USPC ..... 368/69, 187, 188, 185, 190, 288–290
See application file for complete search history.

(56) References Cited

U.S. PATENT DOCUMENTS

| | | | | | |
|---|---|---|---|---|---|
| 4,222,010 | A | * | 9/1980 | Meisner et al. | 327/44 |
| 4,245,338 | A | * | 1/1981 | Sekiya et al. | 368/188 |
| 4,257,114 | A | * | 3/1981 | Sekiya et al. | 368/62 |
| 4,358,837 | A | * | 11/1982 | Yamazaki et al. | 368/69 |
| 4,365,898 | A | * | 12/1982 | Wakai | 368/187 |
| 6,134,189 | A | * | 10/2000 | Carrard | 368/69 |

(Continued)

FOREIGN PATENT DOCUMENTS

| | | | |
|---|---|---|---|
| JP | 2008-122377 | A | 5/2008 |
| JP | 2008-151567 | A | 7/2008 |
| JP | 2010-287325 | A | 12/2010 |

OTHER PUBLICATIONS

Electronic English Translation of Yasuaki, JP 2008-151567.*

(Continued)

*Primary Examiner* — Amy Cohen Johnson
*Assistant Examiner* — Matthew Powell
(74) *Attorney, Agent, or Firm* — Holtz, Holtz, Goodman & Chick PC

(57) ABSTRACT

Disclosed is an electronic timepiece including a rotary switch, a rotation detection unit which detects a rotation of the rotary switch every time the rotary switch rotates for a predetermined rotation angle, a determination unit which determines as a continuous detection when a number of times the rotation detection unit detects the rotation is a predetermined number of times or greater before a preset unit time have elapsed from a detection timing, the predetermined number of times being 2 or more and a control unit which executes a predetermined function when the determination unit determines as the continuous detection.

13 Claims, 8 Drawing Sheets

(56) References Cited

U.S. PATENT DOCUMENTS

| | | | | |
|---|---|---|---|---|
| 2008/0112275 | A1 | 5/2008 | Born et al. | |
| 2010/0142331 | A1* | 6/2010 | Kimura et al. | 368/187 |
| 2010/0309756 | A1 | 12/2010 | Kimura et al. | |

OTHER PUBLICATIONS

Japanese Office Action dated Oct. 8, 2013 (and English translation thereof) in counterpart Japanese Application No. 2011-285599.

* cited by examiner

ELECTRONIC TIMEPIECE AND OPERATION DETECTION METHOD OF ELECTRONIC TIMEPIECE

BACKGROUND OF THE INVENTION

1. Field of the Invention

The present invention relates to an electronic timepiece provided with a rotary switch and an operation detection method of the electronic timepiece.

2. Description of Related Art

Conventionally, there is a watch (timepiece) provided with a rotary switch called winder. Such winder is mainly provided in analog wristwatch with watch hands where the watch hands rotate in conjunction with rotation of the winder.

Such winder may be provided in electronic watch which rotates the watch hands by driving a stepping motor with electric signals. As for the winder provided in such electronic watch, there is suggested a winder including a magnet which rotates in conjunction with rotation of the winder and which recognizes rotation of the winder by detecting rotation of the magnet with a magnetic sensor and rotates the watch hands by driving the stepping motor for the number of steps corresponding to the amount of rotation of the winder. For example, see JP 2008-122377 (corresponding to US 2008/0112275) and JP 2010-287325 (corresponding to US 2010/0309756).

As described above, rotation of the winder provided in an electronic watch does not directly and mechanically make the watch hands rotate. Therefore, when rotation of the winder is detected in an electronic watch provided with winder, not only the watch hands can be moved corresponding to the number of steps equal to the number of times of rotation detected but also other functions can be realized. There is an electronic watch having a function to switch into a state of continuous fast-forwarding of watch hands, as such other functions, when rotation operation of the winder is detected for a predetermined number of times or more within a predetermined unit time.

However, in conventional electronic timepiece, there is a problem in detection method of continuous rotation of the rotary switch. That is, conventional electronic timepiece has a configuration where a time counter is activated at the timing when rotation operation of the rotary switch is detected once and the number of rotation steps of the rotary switch is counted for each period sectioned by unit time by setting the timing of activation as reference. Therefore, when the rotary switch continuously rotates over two periods in the conventional electronic timepiece, such rotation operation of the rotary switch will not be determined as continuous rotation operation due to the number of steps within each unit time not reaching the predetermined number of steps, and the function intended by a user will not occur.

SUMMARY OF THE INVENTION

The present invention provides an electronic timepiece which can unfailingly recognize continuous operation of a rotary switch and an operation detection method of the electronic timepiece.

According to one aspect of the present invention, an electronic timepiece includes a rotary switch, a rotation detection unit which detects a rotation of the rotary switch every time the rotary switch rotates for a predetermined rotation angle, a determination unit which determines as a continuous detection when a number of times the rotation detection unit detects the rotation is a predetermined number of times or greater before a preset unit time have elapsed from a detection timing, the predetermined number of times being 2 or more and a control unit which executes a predetermined function when the determination unit determines as the continuous detection.

According to another aspect of the present invention, an operation detection method in an electronic timepiece having a rotary switch includes detecting a rotation of the rotary switch every time the rotary switch rotates for a predetermined rotation angle, determining as a continuous detection when a number of times the rotation detection unit detects the rotation is a predetermined number of times or greater before a preset unit time have elapsed from a detection timing, the predetermined number of times being 2 or more and executing a predetermined function when the determination unit determines as the continuous detection.

BRIEF DESCRIPTION OF THE DRAWINGS

The above an other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of the present invention will be described with reference to the drawings.

First Embodiment

Figure 1:
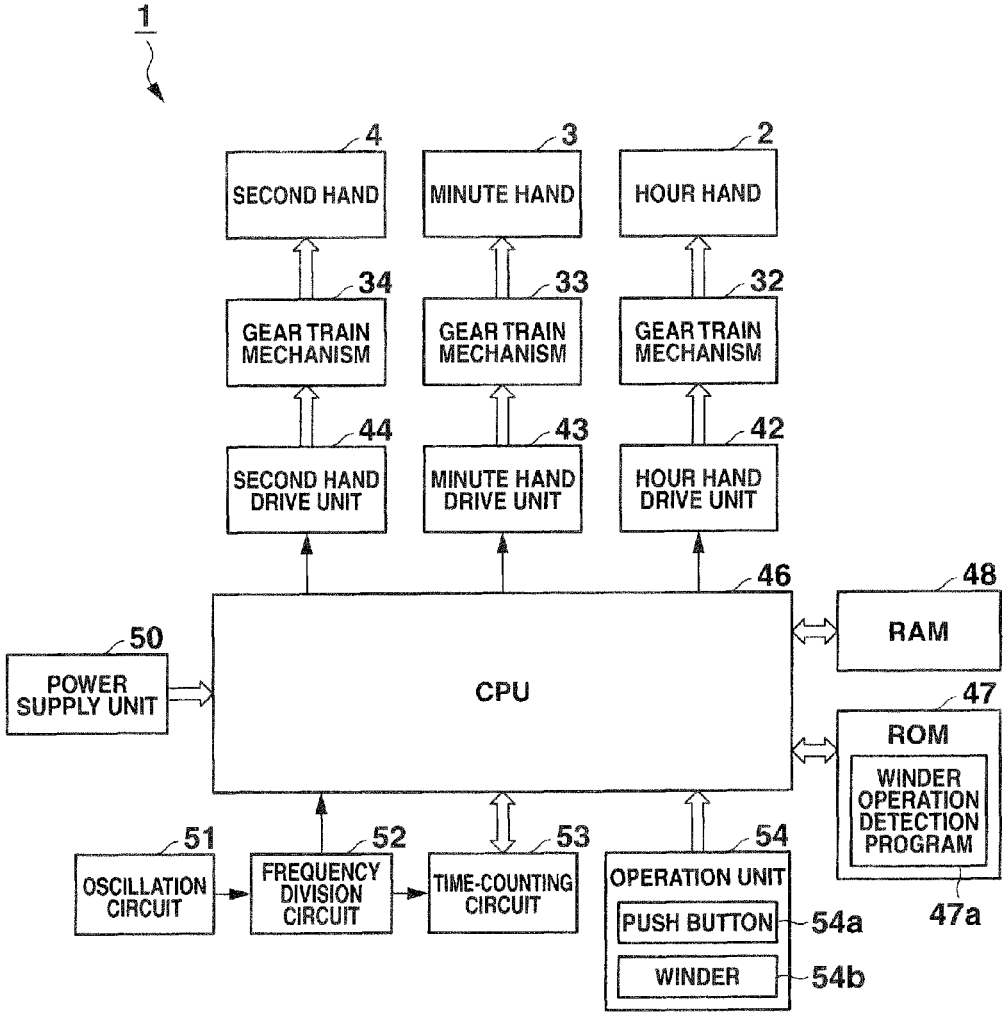
FIG. 1 is a block diagram showing internal configuration of an electronic watch according to an embodiment of the present invention.

FIG. 1 is a block diagram showing an inner configuration of the electronic watch (timepiece) according to the first embodiment.

The electronic watch 1 of the embodiment is an analog electronic watch in which each of the three watch hands can be independently driven. The electronic watch 1 includes an hour hand 2, an hour hand drive unit 42 which rotates the hour hand 2 via a gear train mechanism. 32, a minutes hand 3, a minute hand drive unit 43 which rotates the minute hand 3 via a gear train mechanism 33, a secondhand 4, a second hand drive unit 44 which rotates the second hand 4 via a gear train mechanism 34, a CPU (Central Processing Unit) 46 (determination unit, control unit, interval counting unit, a first elapsed time counting unit, a second elapsed time counting unit, a continuous detection determination unit, a first reference timing changing unit, a second reference timing changing unit, a third reference timing changing unit, a count initialization unit), a ROM (Read Only Memory) 47, a RAM (Random Access Memory) 48 as storage unit, a power supply unit 50, an oscillation circuit 51, a frequency division circuit 52, a time-counting circuit 53 as time-counting unit, an operation unit 54 as rotation detection unit and the like.

The CPU 46 performs various types of arithmetic processing and controls and integrates overall operation of the electronic watch 1. The RAM 48 provides a working memory space to the CPU 46 and temporary data is stored there. Various types of programs which the CPU 46 executes and initial setting data used in those various types of programs are stored in the ROM 47. In such various types of programs stored in the ROM 47, a winder operation detection program 47*a* which detects rotation operation of the after mentioned winder 54*b* and controls the operation on the basis of the detection result is included. The programs and the initial setting data stored in the ROM 47 are to be read out by the CPU 46 at the time of activation of the electronic watch 1 or as needed, and are expanded in the RAM 48 to be executed and used.

Here, the ROM 47 may be replace by any type of rewritable, non-volatile memory such as a flash memory and an EEPROM (Electrically Erasable and Programmable Read Only Memory).

The power supply unit 50 supplies power needed for operation to the CPU 46. Although the power supply unit 50 is not specifically limited, it is a power supply unit which can supply electronic power stably on a long-term basis, for example, by combining a solar cell and a secondary cell.

The oscillation circuit 51 generates a predetermined frequency signal and outputs the generated frequency signal to the frequency division circuit 52. The frequency division circuit 52 divides the frequency signal which is input from the oscillation circuit 51, generates signals of frequencies set by a control signal from the CPU 46 and outputs the generated signal to the CPU 46. Further, the frequency division circuit 52 generates a preset frequency signal (for example, 1 Hz signal) and outputs the generated frequency signal to the time-counting circuit 53. The time-counting circuit 53 is a counter which counts frequency signals which are input to figure out a time. Further, time data which the time-counting circuit 53 figures out can be corrected on the basis of correction command from the CPU 46.

Each of the hour hand drive unit 42, the minute hand drive unit 43 and the second hand drive unit 44 (hereinafter, they may be recited as watch hand drive units 42 to 44 together) includes a stepping motor. The corresponding stepping motors can individually drive the hour hand 2, minute hand 3 and second hand 4 (hereinafter, they may be recited as watch hands 2 to 4 together) on the basis of driving signals (pulse) input from the CPU 46.

The operation unit 54 receives an operation by a user from outside, converts the operation into an electric signal and outputs the electric signal to the CPU 46 as an input signal. The operation unit 54 includes one or a plurality of push button 54*a* and a winder 54*b* (rotary switch). By the push button 54*a* being pressed, function which can be executed in the electronic watch 1 can be switched and the watch hand to be moved by using the after mentioned winder 54*b* can be selected.

The winder 54*b* is a rotary switch which can be rotated by a user. Rotation operation of the winder 54*b* is converted into an electric signal in the operation unit 54 and the electric signal is output to the CPU 46 as an input signal. The winder 54*b* is switched into an operation mode by being pulled out from a casing of the electronic watch 1 for a predetermined length, and an input signal is generated by rotation operation of a predetermined angle being detected in this operation mode. As for method to detect rotation operation of the winder 54*b*, any of the conventional techniques which are well known can be applied. When an input signal is input from the winder 54*b*, the CPU 46 outputs a driving signal to the watch hand drive unit 42, 43 or 44 corresponding to the watch hand 2, 3 or 4 which is selected and set in advance by using the push button 54*a* to rotate the selected watch hand 2, 3 or 4 for a predetermined angle. Here, length the winder 54*b* to be pulled out may be changed in a step-manner and the watch hand to be rotated may be selected according to the length the winder 54*b* is pulled out. When a plurality of input signals are consecutively generated within a predetermined time period by the winder 54*b* and the CPU 46 determines that the input signals are consecutive signals, that is, continuous rotation operation of the winder 54*b*, the CPU 46 is to execute a preset function. In the electronic watch 1 of the embodiment, the CPU 46 moves the watch hand 2, 3 or 4 which is selected and set as mentioned above in fast-forward manner at a predetermined fast-forwarding speed as the preset function.

Next, detection operation of fast-forwarding command of a watch hand in the electronic watch 1 of the embodiment will be described.

Figure 2A:
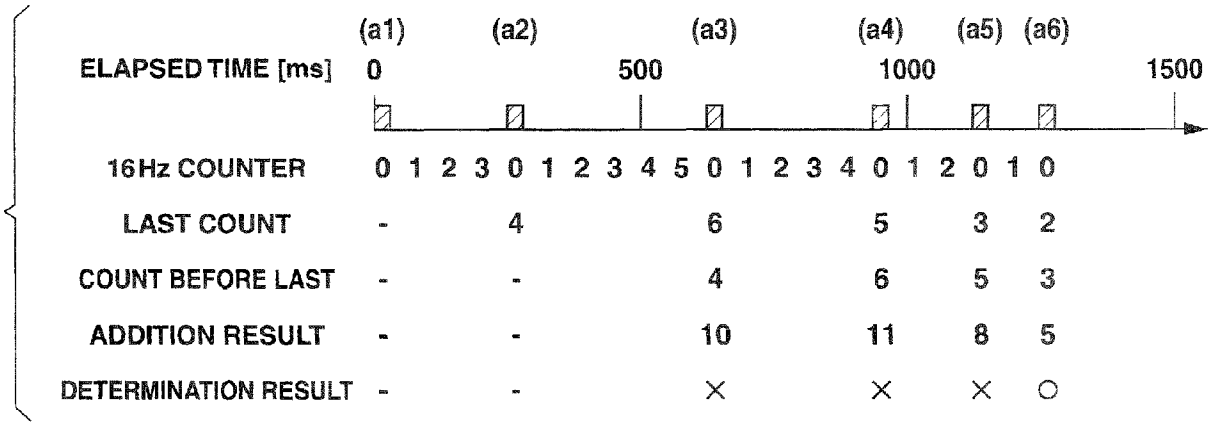
FIGS. 2A and 2B are diagrams for explaining the winder operation detection process according to the first embodiment.

FIG. 2A is a diagram for explaining the detection operation performed by the winder 54*b* to detect watch hand fast-forwarding command in the electronic watch 1 of the first embodiment.

First, when the winder 54*b* detects the first rotation, obtaining of 16 Hz signals starts in the electronic watch 1 by setting this detection timing as reference (FIG. 2A (a1)) and up to eight inputs of 16 Hz signals are counted, a signal being input every 1/16 seconds. When the second rotation operation is detected before the count value reaches 8, the count value at this timing is stored in the RAM 48 as the "last count value" and resets the count value of 16 Hz signals and starts counting again from 0 (FIG. 2A (a2)).

Further, when the third rotation operation is detected before the count value reaches 8, the last count value is set as the count value before last (count value of two counts back) in the RAM 48 and the current count value is newly stored in the RAM 48 as the last count value. That is, the count value before last is the time interval from the first rotation detection timing to the second rotation detection timing, and the last count value is the time interval from the second rotation detection timing to the third rotation detection timing. Therefore, by obtaining the sum of the last count value and the count value before last, the elapsed time from the first rotation detection timing to the third rotation detection timing can be obtained. Thus, in the electronic watch 1, when the third rotation operation is detected and the count value before last and the last count value are set, the count value before last and the last count value are added and whether the third rotation operation are performed before 8/16 seconds (0.5 seconds) have elapsed from the first rotation operation is determined (FIG. 2A (a3)).

When the value of the addition result is 8 or greater, this means that the three rotation operations were not performed before 0.5 seconds have elapsed. In this case, the count value of the 16 Hz counter (counting input 16 Hz signals) is reset and counter is restarted from 0. Then, the last count value is stored as the count value before last and the current count value is set as the last count value every time rotation operation is detected. Thereafter, the last count value and the count value before last are added and determination whether the last three rotation operations were performed before 0.5 seconds have elapsed is repeated (FIG. 2A (a4), (a5), (a6)).

When the value of the addition result of the last count value and the count value before last is smaller than 8, this means that three rotation operations were performed continuously before 0.5 seconds have elapsed (FIG. 2A (a6)). In this case, in the electronic watch 1, the selected watch hand is switched to the fast-forward mode and the watch hand moves in fast-forwarding manner until instruction to stop is input by operating the push button 54*a* or until fast-forwarding for a predetermined number of steps (for example, for the number of steps per cycle that the watch hand needs to go around the dial plate) or to a position (for example, a position in 12 O'clock direction) completes.

In the electronic watch 1 of the embodiment, the current count value is counted in terms of software by increasing the variable which indicates the count number of 16 Hz signals in increments of one in a program. Alternatively, a separate counter circuit may be provided to count the 16 Hz signals.

Figure 3:
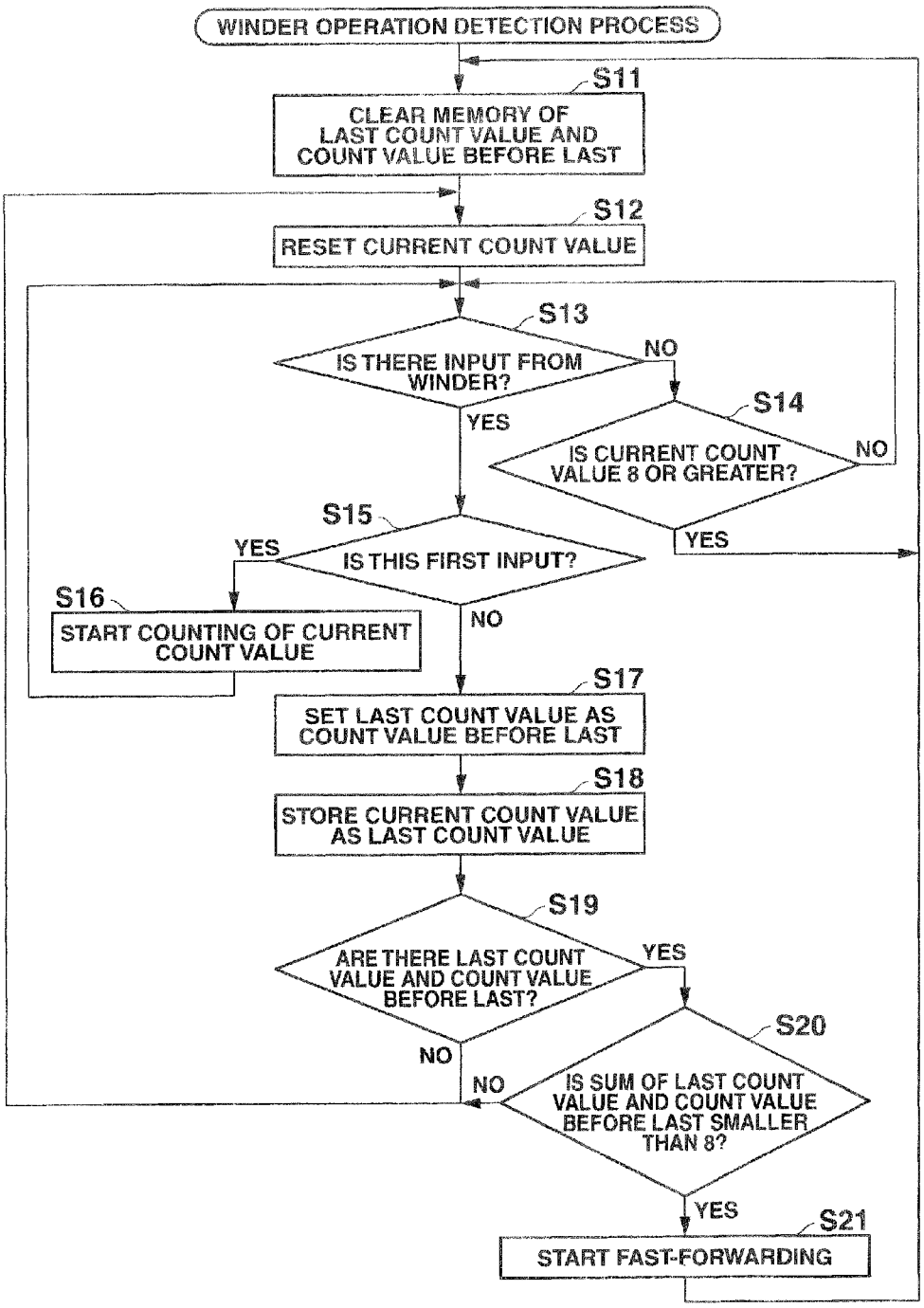
FIG. 3 is a flowchart showing the control procedure of the winder operation detection process according to the first embodiment.

FIG. 3 is a flowchart showing the control procedure performed by the CPU 46 in the winder operation detection process in the electronic watch 1 according to the first embodiment.

For example, the winder operation detection process is called up when the pull-out operation of the winder 54*b* is detected and the CPU 46 executes the process until the winder 54*b* is pushed back in.

When the winder operation detection process starts, the CPU 46 first clears the memory of last count value and the count value before last set in the RAM 48 (step S11). Further, the CPU 46 resets the current count value to "0" (step S12).

Thereafter, the CPU 46 determines whether an input signal (input indicating detection) is input from the winder 54*b* according to detection of rotation operation of the winder (step S13). When the CPU 46 determines that there is no input indicating detection of rotation operation of the winder, the CPU 46 determines whether the current count value is 8 or greater (step S14). When the CPU 46 determines that the current count value is smaller than 8, the process performed by the CPU 46 returns to the process of step S13 and repeats the determination process regarding whether an input indicating detection of rotation operation of the winder occurred. When the CPU 46 determines that the current count value is 8 or greater, the process performed by the CPU 46 returns to the process of step S11 and restarts the winder operation detection process from the beginning.

When it is determined that an input indicating detection of rotation operation of the winder occurred in the determination process of step S13, the CPU 46 determines whether this input indicating detection of rotation operation of the winder is the first input, that is, whether the current count value is in a reset state (step S15). When the CPU 46 determines that this input is the first input, the CPU 46 starts counting of the current count value using 16 Hz signals obtained from the frequency division circuit 52 (step S16). Thereafter, the process performed by the CPU 46 returns to the process of step S13 and waits for the next input indicating rotation operation of the winder.

When it is determined that the input indicating rotation operation of the winder is the second input or thereafter in the determination process of step S15, the CPU 46 next sets the last count value as the count value before last in the RAM 48 (step S17). At this time, when the input indicating detection of rotation operation of the winder is the second input and the last count value and the count value before last are both cleared, the count value before last remains to be in cleared state. Thereafter, the CPU 46 stores the current count value as the last count value in the RAM 48 (step S18). Then, the CPU 46 determines whether both last count value and the count value before last are preserved (step S19). When it is determined that either one of last count value and count value before last is not preserved, that is, either the last count value or the count value before last is cleared, the process performed by the CPU 46 returns to the process of step S12 and the CPU 46 resets the current count value and waits for the next input indicating rotation operation of the winder.

When it is determined that both last count value and count value before last are preserved, the CPU 46 next calculates the sum of the last count value and the count value before last, and determines whether the sum value is smaller than 8 (step S20). When the CPU 46 determines that the sum value is not smaller than 8, the process performed by the CPU 46 returns to the process of step S12. On the other hand, when the CPU 46 determines that the sum value is smaller than 8, the CPU 46 starts the fast-forwarding process of the selected watch hand (step S21). Then, when the fast-forwarding process of the watch hand ends, the process performed by the CPU 46 returns to the process of step S11 and restarts the winder operation detection process from the beginning.

As described above, the electronic watch 1 of the first embodiment is provided with the operation unit 54 including the winder 54*b*, and the operation unit 54 detects rotation of the winder 54*b* for every predetermined rotation angle and outputs signals that correspond to the detection to the CPU 46. The CPU 46 counts the time intervals between the input signals (inputs indicating detection) from the operation unit 54 by using the 16 Hz signals and determines whether the counted time interval during which the last three inputs indicating detection occurred is shorter than a unit time (0.5 seconds). Thereby, the CPU 46 determines whether the last three operations of the winder are continuous input. That is, differently from the conventional way of detecting continuous detection, continuous detection can be unfailingly detected on the basis of the three continuous rotation operations of the winder.

Moreover, the counted time interval between the input indicating detection of this time and the last input indicating detection of every input indicating detection is stored in the RAM 48, and the sum of the count value before last which is the time interval from the input indicating detection before last input to the last input indicating detection, and the last count value which is the time interval from the last input indicating detection to the input indicating detection of this time is obtained based. Based on the sum of the count values whether the time period during which the three inputs indicating detection occurred is shorter than a predetermined unit time is determined (0.5 seconds). In such way, it is sufficient that the time interval between consecutive inputs indicating detection is stored every time, and that the sum of the time intervals between the number of inputs set as the reference for determining continuous operation minus one input is obtained. Therefore, whether the winder is operated continuously for the number of times set as reference for determining that the operations are continuous operation can be determined easily without any complicated processes required.

Specifically, when the time (numerical value) such as the present time and set time for alarm is to be manually corrected by a user, continuous rotation operation of the winder 54*b* can be determined accurately and the time (numerical value) can be switched to fast-forward operation. Therefore, operational burden put on a user can be reduced in the electronic watch 1.

Further, by applying the present invention to an analog electronic watch 1, not only the winder 54*b* can be used similarly as a winder in the conventional analog watch but the watch hands 2, 3 and 4 can be rotated while suppressing the burden to be put on a user.

Modification Example

Figure 2B:
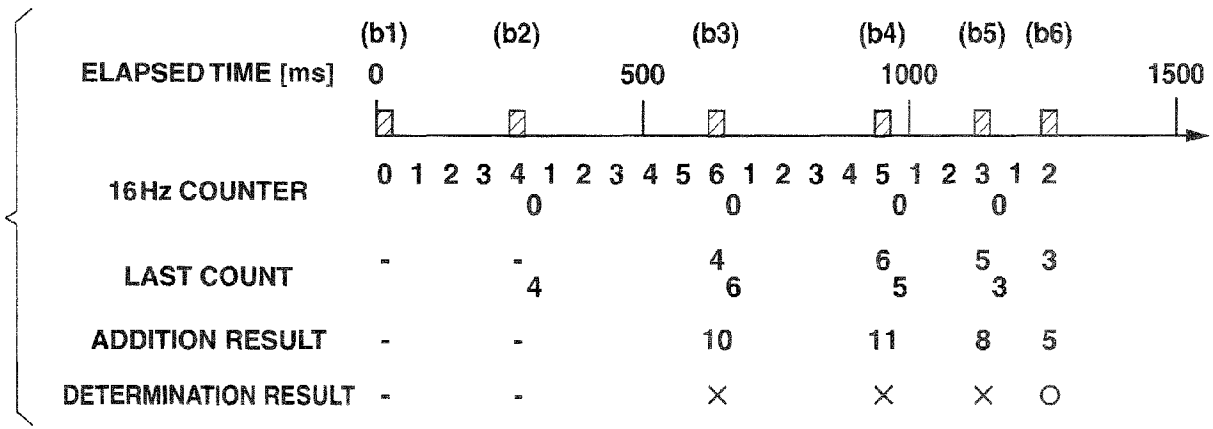

FIG. 2B is a diagram for explaining a modification example of the detection operation to detect a command for fast-forwarding a watch hand by the winder 54*b* in the electronic watch 1.

In this modification example, when rotation operation of the winder 54*b* is detected for the second time or thereafter (FIG. 2B (b2 to b6)), the time interval during which rotation operation of the winder performed three times is calculated by obtaining the sum of the last count value which is preserved at that time and the current count value, and whether these three rotation operations are continuous operation is determined. Then, after the determination, the current count value is stored in the RAM 48 as the last count value and the current count value is reset to 0. In this modification example, the count value before last is not stored nor used.

Figure 4:
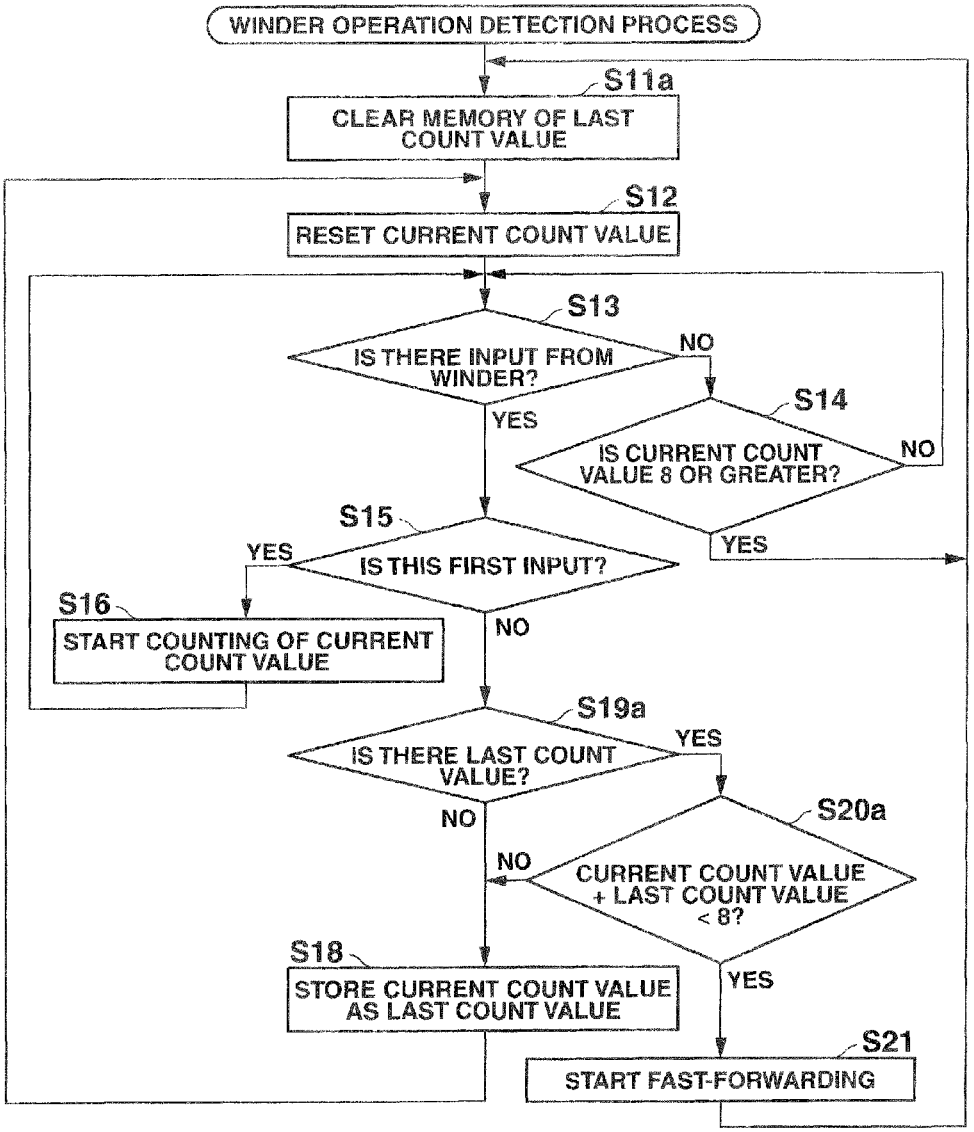
FIG. 4 is a flowchart showing a modification example of the control procedure of the winder operation detection process according to the first embodiment.

FIG. 4 is a flowchart showing the modification example of the control procedure of the winder operation detection process performed in the electronic watch 1 of the first embodiment.

In this modification example of the winder operation detection process, steps S11, S19 and S20 in the winder operation detection process of the first embodiment are replaced respectively with steps S11*a*, S19*a* and S20*a*. Further, the process of step S17 in the winder operation detection process is excluded and the order for the process of step S18 to be performed is changed to after the process of step S19*a*. Other processes are same as those in the winder operation detection process of the first embodiment. Therefore, the same reference numerals are used for the same processes and descriptions thereof are omitted.

In the modification example of the winder operation detection process, because the count value before last is not preserved, the CPU 46 first only clears the memory of last count value stored in the RAM 48 (step S11*a*) when the winder operation detection process is started. Further, when the input indicating detection of rotation operation of the winder is determined as being the second input or thereafter in the process of step S15, the process performed by the CPU 46 moves onto the process of step S19*a* and the CPU 46 determines whether the data of last count value is stored in the RAM 48. When the CPU 46 determines that the data of last count value is stored in the RAM 48, the CPU 46 calculates the sum of the current count value and the last count value and determines whether the sum value is smaller than 8 (step S20*a*). When the CPU 46 determines that the sum value is smaller than 8, the process performed by the CPU 46 moves onto the process of step S21. When the CPU 46 determines that the sum value is not smaller than 8 and when the CPU 46 determines that the data of last count value is not stored in the RAM 48 in the determination process of step S19*a*, the CPU 46 stores the current count value as the last count value in the RAM 48 (step S18). Thereafter, the process performed by the CPU 46 returns to the process of step S12.

As described above, according to the winder operation detection process in the electronic watch 1 of the modification example, similarly to the electronic watch 1 of the first embodiment, determination whether the rotation operation of the winder is continuous operation can be made easily and unfailingly by counting the detection interval of the last three rotation operations of the winder.

Second Embodiment

Next, the electronic watch 1 according to the second embodiment will be described.

The internal configuration of the electronic watch 1 of the second embodiment is the same as that of the electronic watch of the first embodiment. Therefore, same reference numerals are used and descriptions are omitted.

Figure 5:
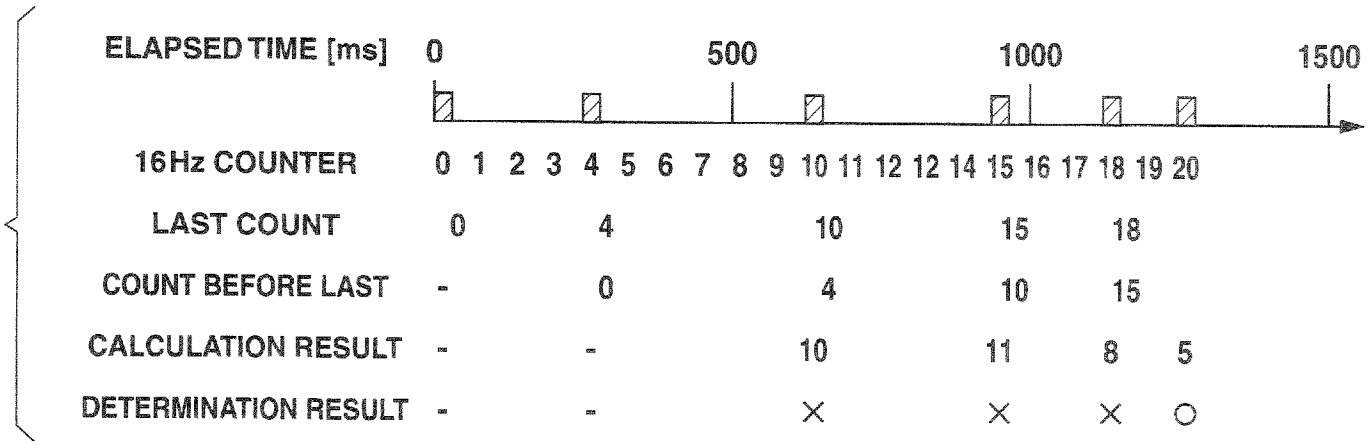
FIG. 5 is a diagram for explaining the winder operation detection process according to the second embodiment.

FIG. 5 is a diagram for explaining the detection operation for detecting the command for fast-forwarding the watch hand given by the winder 54*b* in the electronic watch 1 of the second embodiment will be described.

In the electronic watch 1 of the second embodiment, when the first rotation operation of the winder is detected, obtaining and counting of 16 Hz signals are started. Further, a difference between the current count value of 16 Hz signals and the count value before last is calculated every time rotation operation of the winder is detected, and whether these three rotation operations of the winder are continuous operation is determined by determining whether the difference is smaller than 8. When this determination result is not true and when count value before last is still in the cleared state, the last count value is set as the count value before last in the RAM 48 and the current count value is stored in the RAM 48 as the last count value.

At this time, because the difference between the current count value and the count value before last is the only information required, there is no need to reset the current count value.

Figure 6:
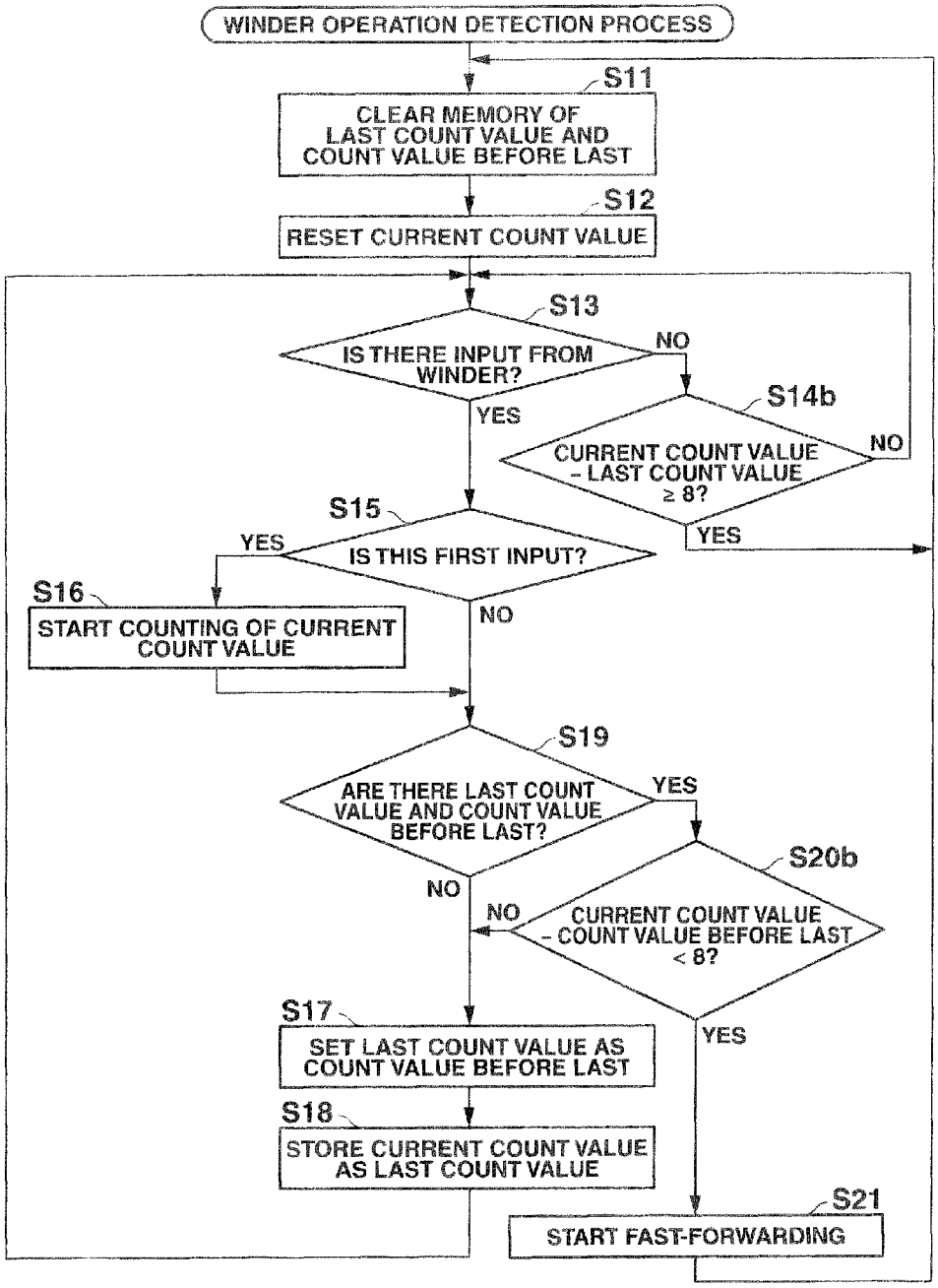
FIG. 6 is a flowchart showing the control procedure of the winder operation detection process according to the second embodiment.

FIG. 6 is a flowchart showing the control procedure performed by the CPU 46 in the winder operation detection process in the electronic watch 1 of the second embodiment.

In the control procedure of the winder operation detection process in the electronic watch 1 of the second embodiment, steps S14 and S20 in the control procedure of the winder operation detection process in the winder operation detection process of the electronic watch 1 of the first embodiment are replaced respectively by steps S14*b* and S20*b*. Further, changes are made in the flow of the processes of steps S16 to S20*b*. With respect to the same processes, the same reference numerals are used and descriptions thereof are omitted.

When it is determined that there is no input indicating detection of rotation operation of the winder 54*b* in the determination process of step S13, the CPU 46 obtains the subtraction value where the last count value is subtracted from the current count value. Then, the CPU 46 determines whether the value of subtraction result is 8 or greater (step S14*b*). When the CPU 46 determines that the value of subtraction result is smaller than 8, the process performed by the CPU 46 returns to the process of step S13 and repeats the determination operation regarding whether an input indicating detection of rotation operation of the winder 54*b* occurred or not. On the other hand, when the CPU 46 determines that the value of subtraction result is 8 or greater, the process performed by the CPU 46 returns to the process of step S11 and restarts the winder operation detection process from the beginning.

In the process of step S16, the CPU 46 starts counting of the current count value. Thereafter, the process performed by the CPU 46 moves onto the process of step S19. The CPU 46 determines whether last count value and the count value before last are stored in the RAM 48 (step S19). When the CPU 46 determines that last count value and the count value before last are stored and preserved, the CPU 46 obtains the subtraction value where the count value before last is subtracted from the current count value and determines whether this value is smaller than 8 (step S20*b*).

When the CPU 46 determines that the value of subtraction result is smaller than 8, the CPU 46 starts the fast-forwarding process of the selected watch hand (step S21). On the other hand, when the CPU 46 determines that the value of subtraction result is 8 or greater, the process performed by the CPU 46 moves onto the process of step S17.

Moreover, when the CPU 46 determines that last count value or the count value before last is not stored in the RAM 48 in the determination process of step S19, the process performed by the CPU 46 moves onto the process of step S17.

When the process performed by the CPU 46 moves onto step S17 from the determination process of step S19 or step S20*b*, The CPU 46 sets and stores the last count value as the count value before last in the RAM 48. Then, the CPU 46 stores the current count value in the RAM 48 as the last count value (step S18). Thereafter, the process performed by the CPU 46 returns to the process of step S131

As described above, in the electronic watch 1 of the second embodiment, count values are obtained respectively at the timings when rotation operation of the winder 54*b* is detected from the counter which counts elapsed time, and the obtained count values are stored in the RAM 48. Then, difference between the current count value of the counter and the count value before last which is stored in the RAM 48 is obtained, and whether the rotation operation of the winder 54*b* is continuous operation can be determined by whether the obtained difference is shorter than the unit time. Therefore, the time interval during the three contiguous rotation operations of the winder can be counted easily without resetting the counter, and determination whether the three rotation operations of the winder are continuous operation can be made unfailingly.

Here, when the winder operation detection process is started in the electronic watch 1 of the second embodiment, it is not necessary to reset the current count value in the process of step S12. Further, when 16 Hz signals are being counted for another purpose although counting of the current count value is started in the process of step S16, the count value can be used as it is.

Moreover, in the winder operation detection process in the electronic watch 1 of the embodiment, maximum value is not set for the current count value. However, by arbitrarily setting the minimum value and the maximum value for the current count value and by adding a process which is to be performed when the count value changes from the maximum value to the minimum value to the process of steps S14*b* and step S20*b*, needed memory may be limited to an arbitrary bit number to perform the winder operation detection process. For example, the present time having 16 Hz accuracy can be used as it is for the count value.

Third Embodiment

Next, the electronic watch 1 of the third embodiment will be described.

The inner configuration of the electronic watch 1 of the third embodiment is the same as that of the electronic watch of the first embodiment. Therefore, the same reference numerals are used and descriptions thereof are omitted.

Figure 7:
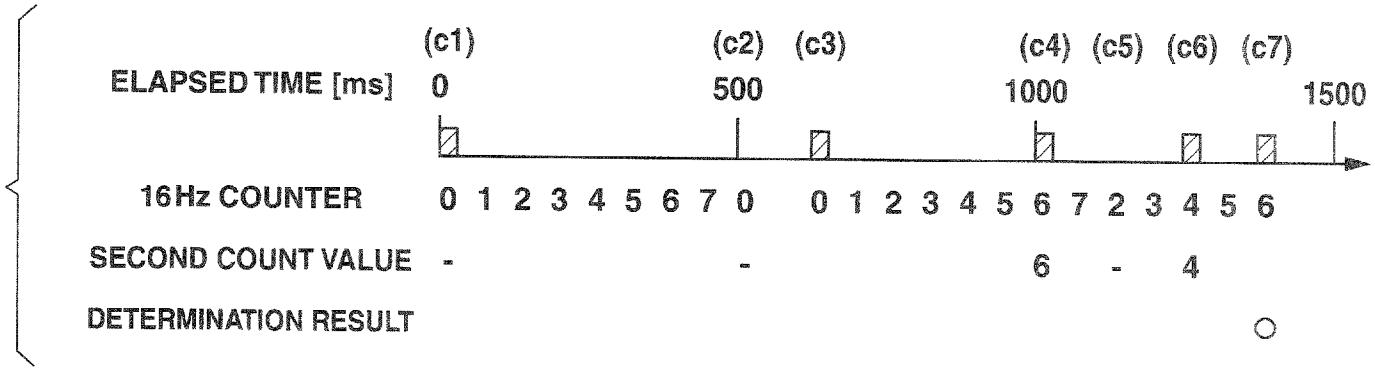
FIG. 7 is a diagram for explaining the winder operation detection process according to the third embodiment.

FIG. 7 is a diagram for explaining the detection operation to detect the command for fast-forwarding the watch hand performed by the winder 54*b* in the electronic watch 1 of the third embodiment.

In the electronic watch 1 of the third embodiment, when rotation operation of the winder 54*b* is detected and obtaining and counting of 16 Hz signals is started (FIG. 7 (c1, c3)), the current count value is reset at the time the current count value reached the maximum value of 8. First, when the second rotation operation is not detected until the current count value reaches 8 after counting of the current count value is started, counting of the current count value is ended and the current count value is reset (FIG. 7 (c2)). Next, when the second rotation operation is detected before the current count value reaches 8, the current count value at the timing when the second rotation operation is detected is stored in the RAM 48 as the second count value (FIG. 7 (c4, c6)).

When the third rotation operation is detected before the current count value reaches 8 in a state where the second count value is stored in the RAM 48, the current count value is the value corresponding to the time interval between the detection timing of the first operation detection of winder and the detection timing of the third operation detection of winder. Obtaining this time interval by the time means that rotation operation was continuously performed for three times before 500 ms have elapsed. Therefore, the fast-forwarding process is started (FIG. 7 (c7)). On the other hand, when the current count value reaches 8 in a state where the second count value is stored in the RAM 48, the value obtained by subtracting the second count value from "8" is set as the current count value in the RAM 48 and the second count value is cleared (FIG. 7 (c5)). According to such process, in the electronic watch 1, data according to the first rotation operation of the winder where the interval from the third rotation operation of the winder will be 500 ms or greater is cleared, and the timing of the second rotation operation of the winder is set as the first rotation operation of the winder and a new second rotation operation of the winder is awaited to be detected.

Figure 8:
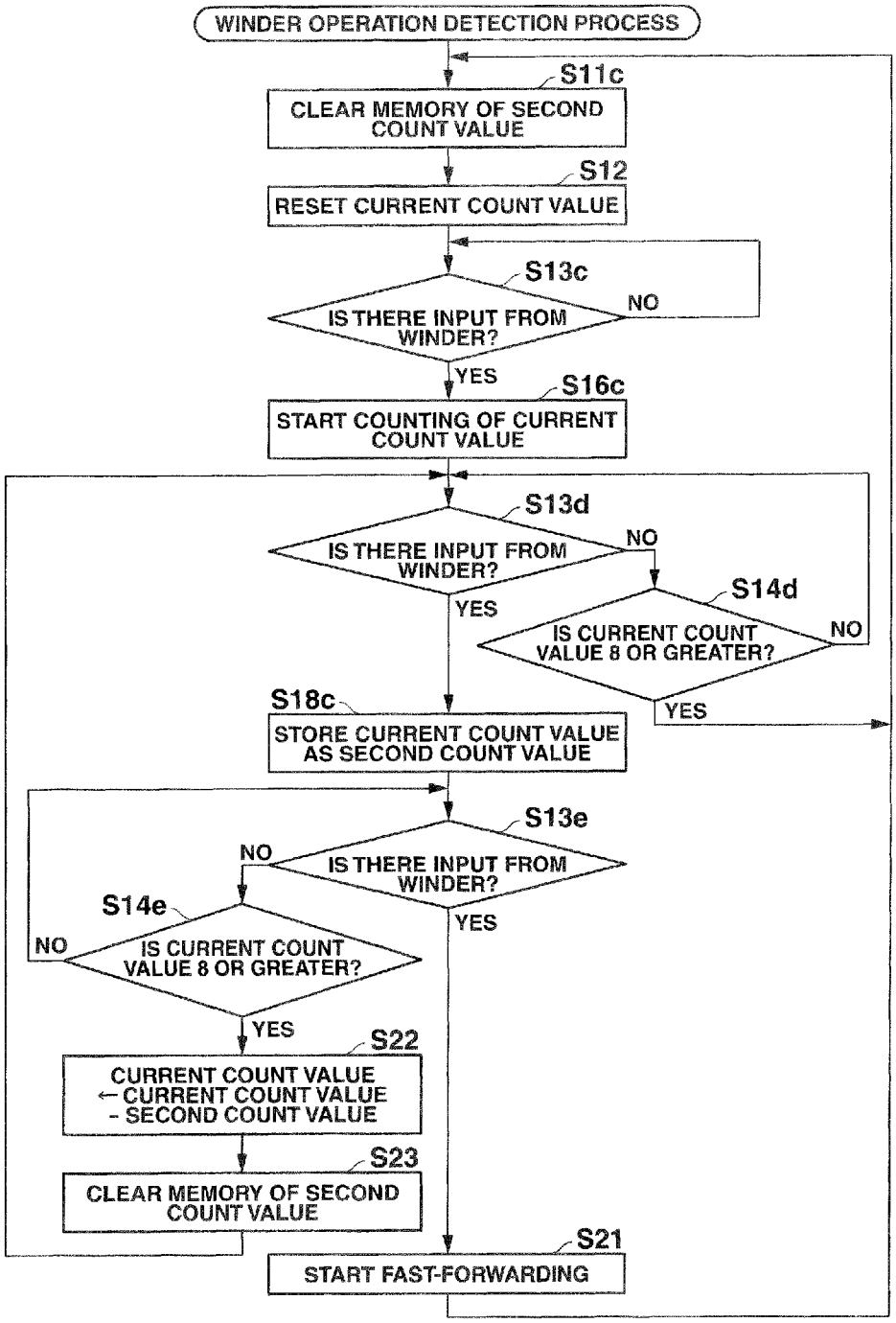
FIG. 8 is a flowchart showing the control procedure of the winder operation detection process according to the third embodiment.

FIG. 8 is a flowchart showing the control procedure performed by the CPU 46 in the winder operation detection process in the electronic watch 1 of the third embodiment.

The winder operation detection process which is executed by the CPU 46 in the electronic watch 1 of the third embodiment is a process where processes of steps S15, S17, S19 and S20 are excluded from the winder operation detection process which are executed in the electronic watch 1 of the first embodiment and instead, processes of steps S22 and S23 are added. Further, the processes of steps S11 and S18 of the winder operation detection process executed in the electronic watch 1 of the first embodiment are changed to processes of steps S11*c* and S18*c* and the processes similar to the processes of steps S13, S14 and S16 of the winder operation detection process executed in the electronic watch 1 of the first embodiment are executed in their respective places indicated as steps S13*c* to S13*e*, step S14*d*, step S14*e* and step S16*c*. The processes of steps S12 and S21 are the same processes in the electronic watch 1 of the first embodiment and in the electronic watch 1 of the third embodiment. Therefore, the same reference numerals are used and the descriptions are omitted.

When the winder operation detection process of the electronic watch 1 of the third embodiment is started, the CPU 46 first clears the memory of count value before last which is stored in the RAM 48 (step S11*c*). Then, the CPU 46 resets the current count value to 0 (step S12) and thereafter determines whether a detection signal indicating rotation operation of the winder is input (step S13*c*). When the CPU 46 determines that a detection signal indicating rotation operation of the winder is not input, the process of step S13*c* is repeated until the CPU 46 determines that a detection signal indicating rotation operation of the winder is input.

When it is determined that a detection signal indicating rotation operation of the winder is input in the process of step S13*c*, the CPU 46 starts obtaining 16 Hz signals and counting for the current count value (step S16*c*).

Thereafter, the CPU 46 determines whether a detection signal indicating rotation operation of the winder is input for the second time (step S13*d*). When it is determined that the second detection signal indicating rotation operation of the winder is not input, the CPU 46 determines whether the current count value is 8 or greater (step S14*d*). When it is determined that the current count value is smaller than 8, the process performed by the CPU 46 returns to the process of step S13*d* and repeats the determination process regarding whether a detection signal indicating rotation operation of the winder is input for the second time or not. When it is determined that the current count value is 8 or greater, the process performed by the CPU 46 return to the process of step S11*c* and starts the winder operation detection process from the beginning.

When a detection signal indicating rotation operation of the winder is input for the second time in the process of step S13*d*, the CPU 46 stores the current count value in the RAM 48 as the second count value (step S18*c*). Then, the CPU 46 further determines whether a detection signal indicating rotation operation of the winder is input for the third time (step S13*e*).

When it is determined that a detection signal indicating rotation operation of the winder is not input for the third time, the CPU 46 determines whether the current count value is 8 or greater (step S14*e*). When it is determined that the current count value is smaller than 8, the process performed by the CPU 46 returns to the process of step S13*e* and the CPU 46 repeats the determination process regarding whether a detection signal indicating rotation operation of the winder is input for the third time or not.

On the other hand, when it is determined that the current count value is 8 or greater in the determination process of step S14*e*, the CPU 46 subtracts the second count value from the current count value and sets the value obtained as the subtraction result as current count value (step S22). Further, the CPU 46 clears the second count value (step S23) and then, the process performed by the CPU 46 returns to the process of step S13*d*.

When it is determined that a detection signal indicating rotation operation of the winder is input for the third time in the determination process of step S13*e*, the CPU 46 performs the fast-forwarding process of the selected watch hand and starts fast-forwarding of the watch hand (step S21). When the fast-forwarding process of the watch hand is ended, the process performed by the CPU 46 returns to the process of step S11*c* and starts the winder operation detection process from the beginning.

As described above, in the electronic watch 1 of the third embodiment, the time interval between the first detection of rotation operation of the winder and the third detection of rotation operation of the winder is counted using the current count value. When the second rotation operation of the winder is detected, the value at this timing is stored in the RAM 48 as the second count value and this is used as the flag indicating the next detection of rotation operation of the winder is the third detection. When 500 ms have elapsed since the first rotation operation of the winder and the current count value reaches 8, by changing the current count value to the value obtained by subtracting the second count value from "8" and clearing the second count value, the second rotation operation of the winder is changed to be set as the first rotation operation of the winder and thereafter, the time interval from the first detection of rotation operation of the winder to the third detection of rotation operation of the winder can be counted by using the current count value continuously thereafter. According to such process, operations performed when rotation operation of the winder is detected and operations performed when the current count value reaches "8" are dispersed and the time interval during which the last three rotation operations of the winder were detected can be counted easily and unfailingly by respective simple processes to determine whether the rotation operations of the winder are continuous operations.

Here, the present invention is not limited to the above described embodiments and various modifications are possible.

For example, although a case where rotation operation of the winder is used for moving the watch hand position in an analog electronic watch is described in the above embodiment, rotation operation of the winder can be used for changing the set time in a digital electronic watch which does not have watch hands. Further, the present invention can be applied to other settings such as switching on/off a function and not only for changing numerical values such as setting time.

Further, in the above embodiment, one counter is provided and the last count value, the count value before last, the second count value and such like are stored in the RAM 48 to be used in order to preserve data of a plurality of timings of rotation operation of the winder. However, a plurality of timings of rotation operation of the winder and a plurality of time intervals of rotation operations of the winder can be counted by operating a plurality of counters in series.

Moreover, although cases where the number of times of detection considered when determined whether rotation operations of the winder are continuous rotation operations is set to three times are described in the above embodiment, rotation operation can be detected for any other number of times.

Here, when rotation operation is to be detected for four times or more, all of the count values obtained at detection timings of rotation operation of the winder from the second detection to the (number of times of detection−1)$^{th}$ detection are to be stored in the RAM 48 in the electronic watch 1 of the third embodiment. Then, in a state where the (number of times of detection−1)$^{th}$ count value is stored, it is determined that rotation operations of the winder are continuous operation when the next rotation operation of the winder is detected before the current count value reaches 8. On the other hand, when the count value reaches 8 in a state where two or more count values are stored, the second count value is subtracted from each of the third count value and the count values thereafter which are stored as well as the current count value, and the count values which are stored in the RAM 48 among the count values from the third count value to (number of detections−1)$^{th}$ count value are set respectively as count values from the second count value to (number of detections−2)$^{th}$ count value. Processes for the other cases are similar to those when the number of time of detection is set to 3 times, and with these processes, whether rotation operations of the winder are continuous rotation operation or not can be determined similarly as when the number of times of detection is set to three time even when the number of time of detection is set to four times or more.

Other aspects such as configuration shown in the above described embodiments and modification example and specific numerical values such as frequency of input signals indicates in the operation procedure and unit time set as reference for determining whether rotation operations of the winder are continuous operation or not, details of order of operation which can be switched can be arbitrarily changed within the scope of the present invention.

The entire disclosure of Japanese Patent Application No. 2011-285599 filed on Dec. 27, 2011 including description, claims, drawings, and abstract are incorporated herein by reference in its entirety.

What is claimed is:

1. An electronic timepiece comprising:

a rotary switch;

a rotation detection unit which detects a rotation of the rotary switch every time the rotary switch rotates for a predetermined rotation angle;

a determination unit which determines a continuous detection when a number of times the rotation detection unit detects the rotation is at least a predetermined number of times before a preset unit time from a detection timing has elapsed, the predetermined number of times being at least 2;

a control unit which executes a predetermined function when the determination unit determines the continuous detection;

an interval counting unit which counts respective time intervals between two adjacent detection timings of the rotation detection unit; and a storage unit which sequentially stores the time intervals which are counted by the interval counting unit, wherein every time the rotation detection unit detects the rotation, the determination unit integrates a plurality of last time intervals which are counted and determines the continuous detection when an integrated time interval is smaller than the preset unit time, said plurality of last time intervals being equal in number to the predetermined number of times the rotation detection unit detects the rotation minus 1.

2. The electronic timepiece according to claim 1, further comprising a time-counting unit which counts a predetermined count value, wherein:

the control unit changes the count value of the time-counting unit by a predetermined correction number every time the rotation detection unit detects the rotation, and the control unit continuously changes the count value in units of the predetermined correction number at a predetermined speed as the predetermined function when the determination unit determines the continuous detection.

3. The electronic timepiece according to claim 2, further comprising:

hands; and stepping motors which drive the hands, wherein the control unit operates the stepping motors and moves the hands to positions corresponding to the predetermined correction number.

4. An electronic timepiece comprising:

a rotary switch;

a rotation detection unit which detects a rotation of the rotary switch every time the rotary switch rotates for a predetermined rotation angle;

a determination unit which determines a continuous detection when a number of times the rotation detection unit detects the rotation is at least a predetermined number of times before a preset unit time from a detection timing has elapsed, the predetermined number of times being at least 2;

a control unit which executes a predetermined function when the determination unit determines the continuous detection;

an elapsed time counting unit which counts an elapsed time which is a time elapsed since a detection timing of the rotation detection unit; and a storage unit which sequentially stores the elapsed times obtained at the detection timings of the rotation detection unit, wherein every time the rotation detection unit detects the rotation, the determination unit calculates a time difference between the elapsed time obtained at the current detection timing and the elapsed time which is stored in the storage unit, and determines the continuous detection when the calculated time difference is smaller than the preset unit time, wherein the elapsed timing stored in the storage unit which is used in the calculating by the determination unit is an elapsed time which was obtained a number of detection timings before the elapsed time obtained at the current detection timing which is used in the calculating by the determination unit, said number of detection timings being equal in number to the predetermined number of times the rotation detection unit detects the rotation minus 1.

5. The electronic timepiece according to claim 4, further comprising a time-counting unit which counts a predetermined count value, wherein:

the control unit changes the count value of the time-counting unit by a predetermined correction number every time the rotation detection unit detects the rotation, and the control unit continuously changes the count value in units of the predetermined correction number at a predetermined speed as the predetermined function when the determination unit determines the continuous detection.

6. The electronic timepiece according to claim 5, further comprising:

hands; and stepping motors which drive the hands, wherein the control unit operates the stepping motors and moves the hands to positions corresponding to the predetermined correction number.

7. An electronic timepiece comprising:

a rotary switch;

a rotation detection unit which detects a rotation of the rotary switch every time the rotary switch rotates for a predetermined rotation angle;

a determination unit which determines a continuous detection when a number of times the rotation detection unit detects the rotation is at least a predetermined number of times before a preset unit time from a detection timing has elapsed, the predetermined number of times being at least 2;

a control unit which executes a predetermined function when the determination unit determines the continuous detection;

an elapsed time counting unit which counts an elapsed time which is a time elapsed since a first detection timing of the rotation detection unit; and a storage unit which stores the elapsed time obtained at a second detecting timing of the rotation detection unit, wherein the determination unit comprises:

a continuous detection determination unit which determines the continuous detection when the rotation is detected by the rotation detection unit before the second elapsed time counting unit counts up to the preset unit time in a state where the elapsed time is stored in the storage unit;

a reference timing changing unit which subtracts the elapsed time stored in the storage unit from the elapsed time counted by the elapsed time counting unit and deletes the elapsed time stored in the storage unit, when the elapsed time counting unit counts up to the preset unit time in the state where the elapsed time is stored in the storage unit, wherein the elapsed time counting unit continues counting the elapsed time from a reference timing obtained as a calculation result of the subtraction by the reference timing changing unit; and a count initialization unit which resets the elapsed time which is counted by the elapsed time counting unit and sets a next detection made by the rotation detection unit as the first detection timing when the elapsed time counting unit counts up to the preset unit time in a state where the elapsed time is not stored in the storage unit.

8. The electronic timepiece according to claim 7, further comprising a time-counting unit which counts a predetermined count value, wherein:

the control unit changes the count value of the time-counting unit by a predetermined correction number every time the rotation detection unit detects the rotation, and the control unit continuously changes the count value in units of the predetermined correction number at a predetermined speed as the predetermined function when the determination unit determines the continuous detection.

9. The electronic timepiece according to claim 8, further comprising:

hands; and stepping motors which drive the hands, wherein the control unit operates the stepping motors and moves the hands to positions corresponding to the predetermined correction number.

10. An electronic timepiece comprising:

a rotary switch;

a rotation detection unit which detects a rotation of the rotary switch every time the rotary switch rotates for a predetermined rotation angle;

a determination unit which determines a continuous detection when a number of times the rotation detection unit detects the rotation is at least a predetermined number of times before a preset unit time from a detection timing has elapsed, the predetermined number of times being at least 4;

a control unit which executes a predetermined function when the determination unit determines the continuous detection;

an elapsed time counting unit which counts an elapsed time which is a time elapsed since a first detection timing of the rotation detection unit; and a storage unit which stores elapsed times obtained at timings when the rotation detection unit detected the rotation after the first detection timing, the elapsed times stored in the storage unit being most recent elapsed times, wherein the determination unit comprises:

a continuous detection determination unit which determines the continuous detection when the rotation detection unit detects the rotation before the elapsed time counting unit counts up to the preset unit time in a state where the elasped times stored in the storage unit are equal in number to the predetermined number of times the rotation detection unit detects the rotation minus 2;

a first reference timing changing unit which subtracts a smallest value among the elapsed times stored in the storage unit from the current elapsed time which is counted by the second elapsed time counting unit and from each of other elapsed times stored in the storage unit and deletes the smallest value from the storage unit when the second elapsed time counting unit counts up to the preset unit time in a state where at least two elapsed times are stored in the storage unit, wherein the elapsed time counting unit continues counting the elapsed time from a reference timing obtained by the subtraction of the smallest value from the current elapsed time by the first reference timing changing unit;

a second reference timing changing unit which subtracts the elapsed time stored in the storage unit from the current elapsed time which is counted by the elapsed time counting unit and deletes the elapsed time stored in the storage unit when the elapsed time counting unit counts up to the preset unit time in a state where only one elapsed time is stored in the storage unit, wherein the elapsed time counting unit continues counting the elapsed time from a reference timing obtained by the subtraction of the elapsed time stored in the storage unit from the current elapsed time by the second reference timing changing unit; and a counting initialization unit which resets the elapsed time which is counted by the elapsed time counting unit and sets a next detection made by the rotation detection unit as the first detection timing when the elapsed time counting unit counts up to the preset unit time in a state where the elapsed time is not stored in the storage unit.

11. The electronic timepiece according to claim 10, further comprising a time-counting unit which counts a predetermined count value, wherein:

the control unit changes the count value of the time-counting unit by a predetermined correction number every time the rotation detection unit detects the rotation, and the control unit continuously changes the count value in units of the predetermined correction number at a predetermined speed as the predetermined function when the determination unit determines the continuous detection.

12. The electronic timepiece according to claim 11, further comprising:

hands; and stepping motors which drive the hands, wherein the control unit operates the stepping motors and moves the hands to positions corresponding to the predetermined correction number.

13. An operation detection method in an electronic timepiece which includes a rotary switch, the method comprising:

detecting a rotation of the rotary switch every time the rotary switch rotates for a predetermined rotation angle;

determining a continuous detection when a number of times the rotation is detected is at least a predetermined number before a preset unit time has elapsed from a detection timing, the predetermined number of times being at least 2; and executing a predetermined function when the continuous detection is detected;

counting respective time intervals between two adjacent detection timings of the rotation of the rotary switch; and sequentially storing the counted time intervals;

wherein every time the rotation of the rotary switch is detected, a plurality of last time intervals which are counted are integrated, and the continuous detection is determined when an integrated time interval is smaller than the preset unit time, said plurality of last time intervals being equal in number to the predetermined number of times the rotation of the rotary switch is detected minus 1.

* * * * *

UNITED STATES PATENT AND TRADEMARK OFFICE

CERTIFICATE OF CORRECTION

PATENT NO. : 9,058,022 B2
APPLICATION NO. : 13/721362
DATED : June 16, 2015
INVENTOR(S) : Teruhisa Tokiwa et al.

It is certified that error appears in the above-identified patent and that said Letters Patent is hereby corrected as shown below:

In the Claims

Column 14, claim 7, line 62-63, before “elapsed” delete “second”.

Column 15, claim 10, line 62, delete “elasped” and insert --elapsed--.

Column 16, line 2, before “elapsed” delete “second”.

Column 16, line 5, before “elapsed” delete “second”.

Signed and Sealed this
Third Day of May, 2016

Michelle K. Lee

Michelle K. Lee
*Director of the United States Patent and Trademark Office*